US006830171B2

(12) United States Patent
Canella et al.

(10) Patent No.: US 6,830,171 B2
(45) Date of Patent: Dec. 14, 2004

(54) PADDING ELEMENT FOR DIVER'S BOTTLE-SUPPORTING BACKPACK

(75) Inventors: Gabriele Canella, Rapallo (IT); Aristide Barone, Rapallo (IT)

(73) Assignee: HTM Sport S.p.A. (IT)

( * ) Notice: Subject to any disclaimer, the term of this patent is extended or adjusted under 35 U.S.C. 154(b) by 105 days.

(21) Appl. No.: 10/346,113

(22) Filed: Jan. 17, 2003

(65) Prior Publication Data

US 2004/0004100 A1 Jan. 8, 2004

(30) Foreign Application Priority Data

Jul. 5, 2002 (IT) ..... GE20020012 U

(51) Int. Cl.[7] ..... A45F 3/04

(52) U.S. Cl. ..... 224/644; 224/262; 224/637; 224/642; 224/907; 224/934

(58) Field of Search ..... 224/155, 261, 224/262, 628, 637, 642, 644, 907, 901.2, 901.8, 934; 5/653

(56) References Cited

U.S. PATENT DOCUMENTS 3,114,486 A * 12/1963 Flexman ..... 224/628
3,355,075 A * 11/1967 Dean ..... 224/262
4,164,798 A * 8/1979 Weber ..... 5/653
4,420,103 A * 12/1983 Douglass ..... 224/261
4,752,263 A * 6/1988 Pritchard et al. ..... 224/934
4,824,169 A * 4/1989 Jarrell ..... 5/653
4,925,064 A * 5/1990 Comora ..... 224/155
5,131,576 A * 7/1992 Turnipseed ..... 224/262
5,553,759 A * 9/1996 McMaster et al. ..... 224/261
5,573,155 A * 11/1996 Sadler ..... 224/155
5,573,166 A * 11/1996 Leja ..... 224/644
5,702,153 A * 12/1997 Pliska ..... 5/653
5,725,139 A * 3/1998 Smith ..... 224/637

* cited by examiner

*Primary Examiner*—Gary E. Elkins
(74) *Attorney, Agent, or Firm*—Marvin Petry; Stites & Harbison PLLC

(57) ABSTRACT

A padding element for the dorsal side of a diver's bottle-supporting backpack. The padding element comprises a padded cushion capable of being fitted against the back part of the backpack and having at its lower edge a padded cushion part hinged to it and capable of being either folded upwards, in order to increase the total thickness, and hence the padding action of the cushion over the diver's sacrococcygeal region, or unfolded downwards to give the diver extended protection beyond the lower edge of the bottle or bottles attached to the backpack.

3 Claims, 1 Drawing Sheet

PADDING ELEMENT FOR DIVER'S BOTTLE-SUPPORTING BACKPACK

BACKGROUND AND SUMMARY OF THE INVENTION

The present invention relates to backpacks containing the harness for bottles of compressed air, and the shoulder straps to enable divers to wear the said backpacks. One problem with these backpacks is the provision of adequate padding between the anterior part of the backpack and the back of the user, to make it as comfortable as possible for the user.

As regards this point, one of the regions of a diver most subject to bumping is the sacrococcygeal region, so it is one object of the present invention to provide a padding element that offers the possibility of really effective protection for this region.

However, there is another, equally familiar, problem, and that is the matter of how to extend the protection beyond the lower limit of the backpack beyond the bottom edge of the bottle or bottles, in order also to protect, as an alternative, the posterior region of the thighs of the user from the constant bumping of the bottom edge of the bottles during swimming.

The main object of the present invention is therefore to provide a backpack padding element that can be used either to give increased padding to the sacrococcygeal region of the user or to provide protection for the upper region of the posterior part of the thighs of the user, and that can be converted easily between the two functions by a quick and simple action that can be performed even during the dive itself, according to the needs of the moment.

BRIEF DESCRIPTION OF THE DRAWINGS

Other objects and advantages of the present invention will be made clear in the course of the following detailed description of a preferred embodiment thereof, made with reference to the accompanying drawing in which.

DESCRIPTION OF THE PREFERRED EMBODIMENT OF THE INVENTION

Figure 2:
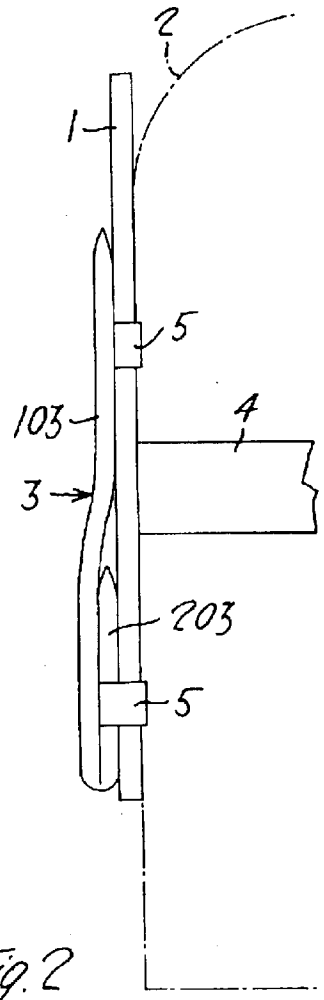
FIG. 2 is a right side elevation of the backpack of FIG. 1.

With reference to the drawing, the number 1 denotes a backpack of the type used by a diver for carrying a bottle 2 of compressed air during a scuba dive. As illustrated, the bottle 2 is attached to the dorsal side of the backpack 1 by suitable strapping 4. Attached to the other side of the backpack 1, that is on its anterior side designed to be placed against the diver's back, is the padding element 3. This element 3 consists of two sheets of fabric, or similar material, enclosed between which is a padding material such as an expanded material. In the embodiment illustrated, this element 3 is roughly almond-shaped, and it is divided into two parts: a main part 103 whose outline is roughly that of a pointed arch, and a lower flap or tailpiece 203 of approximately triangular shape, hinged to the part 103 by an unpadded piece of fabric. This padding element 3 is attached to the backpack 2 by for example straps 5, which hook and loop type fastening elements at their ends and are passed through slots formed in the backpack 2. The operation of the device described above will be obvious.

Figure 1:
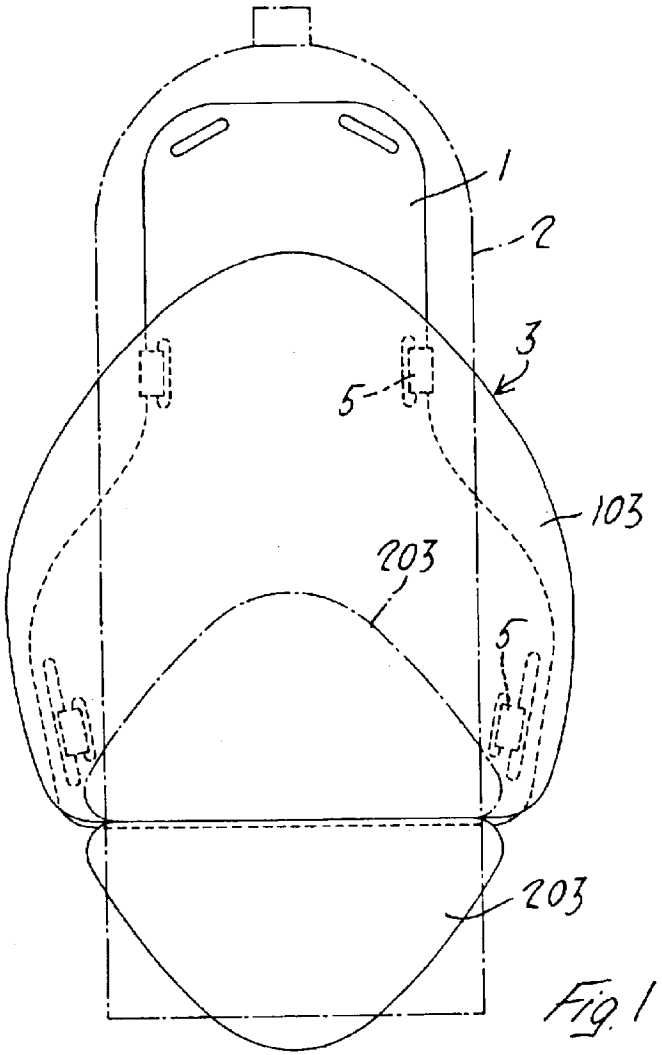
FIG. 1 is an elevational view from the anterior side, that is the side not supporting the bottle or bottles, of a bottle-supporting backpack provided with the padding element according to the invention.

Referring to the drawing, FIG. 2 shows the condition in which the flap 203 is used to provide maximum padding in the diver's sacrococcygeal region. In this condition the flap 203 is folded up and inserted between the portion 103 and the backpack 1, as illustrated in solid lines in FIG. 2, or as illustrated in chain lines in FIG. 1. If however it is wished to extend the protection of the padded element 3 beyond the backpack 1, to protect the upper part of the thighs of the diver against the bumping of the bottom of the bottle 1, this flap 203 is folded out of the position illustrated in chain line in FIG. 1, and is dropped down as illustrated in solid lines in FIG. 1.

The present invention is not of course limited to the embodiment illustrated and described. For example, the shape of the padded element may vary considerably. Also, it is conceivable to fold the flap 203 forward of the part 103, rather than behind it, and secure it in the folded position of greatest thickness by for example a Velcro fastening system or the like.

The scope of the present invention therefore includes all such modifications and variations applied to a padding element for a bottle-supporting backpack for a diver that come within the scope of the appended claims.

What is claimed is:

1. Padding element for the dorsal side of a diver's bottle-supporting backpack, in which the said padding element comprises a first padded cushion capable of being attached against the anterior part of the said backpack designed to be placed against the diver's back, and having at its lower edge a second padded cushion hinged to it and capable of being either folded upwards, in order to increase the total thickness of the padding, and hence the protective action of the said cushion over the diver's sacrococcygeal region, or unfolded downwards to give the diver extended protection beyond the lower edge of the bottle or bottles attached to the said backpack, and wherein the first padded cushion is provided with a releasable means for fastening the first padded cushion to the backpack, the fastening means comprising short strip-like elements which are attached to slots formed in the backpack.

2. Padding element according to claim 1, in which the said strip-like elements are provided with hook and loop type fastening elements.

3. Padding element for the dorsal side of a diver's bottle-supporting backpack according to claim 2 in which the said padding element has a roughly almond-shaped outline, with a main part in the form of an arch with a pointed curve capable of being fitted against the back part of the said backpack, and terminating at the lower edge in a padded part of roughly triangular shape hinged to the main part and capable of being either folded upwards, underneath the said main part, or unfolded downwards to give the diver extended protection beyond the lower edge of the bottle or bottles attached to the said backpack.

* * * * *